US005419424A

United States Patent [19]

Harbaugh

[11] Patent Number: 5,419,424

[45] Date of Patent: May 30, 1995

[54] CURRENCY PAPER SECURITY THREAD VERIFICATION DEVICE

[75] Inventor: Steven K. Harbaugh, Castro Valley, Calif.

[73] Assignee: Authentication Technologies, Inc., Dublin, Calif.

[21] Appl. No.: 234,292

[22] Filed: Apr. 28, 1994

[51] Int. Cl.[6] ..... G07D 7/00

[52] U.S. Cl. ..... 194/206; 324/663

[58] Field of Search ..... 194/206, 207; 209/534; 324/663, 672

[56] References Cited

U.S. PATENT DOCUMENTS

| | | | |
|---|---|---|---|
| 3,980,990 | 9/1976 | Berube . | |
| 4,255,652 | 3/1981 | Weber | 209/534 X |
| 4,355,300 | 10/1982 | Weber | 235/451 |
| 4,524,276 | 6/1985 | Ohtombe | 250/338 |
| 4,652,015 | 3/1987 | Crane | 283/91 |
| 4,761,205 | 8/1988 | Crane | 162/103 |
| 4,980,569 | 12/1990 | Crane et al. | 250/556 |
| 5,122,754 | 6/1992 | Gotaas | 324/676 |
| 5,151,607 | 9/1992 | Crane et al. | 250/556 |
| 5,260,582 | 11/1993 | Danek et al. | 250/556 |
| 5,279,403 | 1/1994 | Harbaugh et al. | 194/207 |
| 5,308,992 | 5/1994 | Crane et al. | 250/556 |

FOREIGN PATENT DOCUMENTS

| | | |
|---|---|---|
| 0133656 | 7/1984 | European Pat. Off. . |
| 0158079 | 2/1985 | European Pat. Off. . |
| 2211976 | 7/1989 | United Kingdom . |

OTHER PUBLICATIONS

IBM Technical Disclosure Bulletin, vol. 28, No. 1, Jun. 1985.

*Primary Examiner*—F. J. Bartuska

*Attorney, Agent, or Firm*—Richard H. Kosakowski; Holland & Associates

[57] ABSTRACT

A currency paper has a security thread embedded therein. The thread comprises a plastic substrate having a plurality of alphanumeric, metallic, electrically-conductive characters formed thereon. The characters have predetermined heights and widths and spacings therebetween. The verification device comprises an oscillator electrode and associated horizontal and vertical electrodes. A time-varying oscillator signal is coupled to the oscillator electrode. The spacing of the horizontal and vertical electrodes in relation to the oscillator electrode is determined by the spacing between the metallized characters on the thread. A valid security thread capacitively couples the oscillator signal into the horizontal electrode but not the vertical electrode. On the other hand, a counterfeit security thread will couple the oscillator signal into both the horizontal and vertical electrodes. Signal processing electronics is provided to sense these valid and counterfeit conditions.

14 Claims, 4 Drawing Sheets

CURRENCY PAPER SECURITY THREAD VERIFICATION DEVICE

BACKGROUND OF THE INVENTION

This invention relates to apparatus for verifying the authenticity of documents, and more particularly, to such apparatus for detecting a metallized security thread embedded in currency paper.

It is known in the art of currency and banknote papers to incorporate a security thread. The use of such security threads has increased due to the prevalence of high-resolution, true-color photocopying machines. If modern currency or banknote papers do not have an embedded security thread, the currency can be more easily duplicated with a color photocopier. However, if the security thread is embedded within the paper, the characteristics of the thread are harder to illicitly reproduce.

The thread may comprise a plastic film having selected aluminum characters formed on a surface. The thread is embedded within the currency paper and is not present on either surface of the paper. Such security threads for use in U.S. currency are described in greater detail in U.S. Pats. Nos. 4,652,015 and 4,761,205 to Timothy Crane, both assigned to Crane & Co., Inc.

The security thread described in these patents has printed characters thereon of extreme fine-line clarity and high opacity such that human-readability of the printing is possible by means of transmitted light. Yet, the printing remains completely indiscernible under reflected light. If the printing were legible under reflected light, the public could rely upon the presence of the printed matter solely under this reflected light. The printing would then be easily replicated by counterfeit means. The aforementioned patents to Crane insure that the public does not come to rely on such an easily simulated security thread characteristic. This is accomplished by a method of manufacturing currency and banknote paper containing a security thread that is virtually invisible under reflected light with no manifestation on the surface of the currency or banknote that such a security thread is present within the note. Thus, authentification of such a security thread is carried out in a two-fold test; namely, wherein the thread is legible under transmitted light and invisible under reflected light.

An easy way of checking the authenticity of such a security thread is to place the currency under an intense light source to observe the characters of the thread by the human eye. However, in commercial situations where such an intense light source is unavailable, thus making a human check for thread presence and authenticity virtually impossible, it is desirable to provide means for automatically determining the thread's presence and authenticity. Various known means for providing verification of the presence and authenticity of the aforementioned security thread are exemplified in U.S. Pats. Nos. 4,980,569 and 5,151,607.

The '569 patent discloses a verification device comprising two optical light source/detector pairs disposed on opposite sides of a currency paper. The source and detector pairs are arranged for transmission and reception of optical energy through the currency if the thread is not present. Also, the source and detector pairs can determine the presence of a counterfeit thread on the currency surface by checking for light reflected off of the currency surface. Thus, the '569 patent provides a two-fold test wherein the thread, to be genuine, must be detected under transmitted light, and not be detected under reflected light. However, the device in the '569 patent may give a false indication of the authenticity of a counterfeit currency when a pencil line is drawn on the currency surface at the normal thread location.

In an attempt to overcome the shortcomings of the '569 patent, the '607 patent discloses a verification device comprising the optical means of the '569 patent in combination with a magnetic detector. The magnetic detector determines the presence of the security thread, while the optical means determines whether the thread is properly within the currency or improperly disposed on either surface.

In light of the shortcomings of optical methods of verifying the presence of the security thread within the currency paper, other means have been developed, such as capacitive verification devices. These devices operate on the principal of detecting a change in capacitance of a sensor, such change being due to the dielectric properties of the metallized security thread. The metallized security thread has dielectric properties that are vastly different from those of the paper in which it is embedded. The security thread operates as one plate of a capacitor, and draws charge off of a second plate of the capacitor, the second plate typically being a part of the verification device. Thus, the security thread effectively increases the capacitance that is sensed by the verification device, a detectable feature.

However, capacitance verification devices have shortcomings in that they can also be fooled by conductive marks, such as pencil lines, placed on the surface of the currency. This can be especially problematic for currency verification devices that are intended to be used for unattended transactions; for example, in vending machines that incorporate currency acceptors. Automatic vending machines, such as those that dispense soft drinks and cigarettes, are gradually accepting higher denomination currency bills in unattended transactions as payment for the goods. This is due to the inflationary prices of the goods. Also, unattended bill acceptors are expanding into areas such as gaming and other entertainment vending areas, and gas stations. The addition of bill acceptors and/or changers in these vending machines has resulted in a large increase in sales for unattended transactions. For these types of machines, it is imperative that the bill acceptor/changer have some means for reliably discriminating between genuine and counterfeit bills.

Accordingly, it is a primary object of the present invention to provide a capacitive-induction, security thread verification device that differentiates a counterfeit conductive line on a surface of currency paper from a genuine security thread embedded within the currency paper.

It is a general object of the present invention to provide a reliable security thread verification device for use in bill acceptors/changers in markets which require a high level of security in the verification device as these markets add increasingly high denomination capabilities into the acceptor/changer apparatus.

It is another object of the present invention to provide a device that verifies the presence of a genuine security thread embedded within currency paper by utilizing the known physical spacing between the metallized electrically-conductive characters formed on a surface of a non-conductive thread substrate embedded within the currency paper.

It is a still further object of the present invention to provide a capacitance-based, security thread verification device that is used for slower-speed, narrow-end-fed bill acceptor/changer devices that are incorporated into unattended, self-serve vending machines, bill changers, and the like.

It is a still further object of the present invention to machine-detect the presence of an advanced counterfeit deterrent thread in currency in a wide array of commercial, unattended cash-handling devices.

It is yet another object of the present invention to provide a counterfeit detection capability for currency paper that is superior to currently available technologies, such as optics and magnetics.

It is still another object of the present invention to reliably identify counterfeit currency regardless of the quality of the banknote or the counterfeit.

It is yet still another object of the present invention to provide a security thread verification device that is relatively inexpensive and easily incorporated into existing automated, unattended vending machines.

It is another object of the present invention to provide a security thread verification device with increased speed and reliability of counterfeit detection.

The above and other objects and advantages of this invention will become more readily apparent when the following description is read in conjunction with the accompanying drawings.

SUMMARY OF THE INVENTION

To overcome the deficiencies of the prior art and to achieve the objects listed above, the Applicant has invented a verification device for security threads embedded within currency paper. In the preferred embodiment, the verification device is for use with security threads that comprise a thin plastic non-conductive substrate whose length spans the entire height of the banknote. A surface of the substrate has metallic, electrically-conductive, alphanumeric characters formed thereon. The characters are physically separate from each other so that the metallic material is not continuous across the entire length of the thread. The characters all have a constant predetermined height and varying widths. The width depends upon the particular character. The height of the characters is oriented perpendicular to the major axis of the thread.

The verification device comprises a planar circuit board having two or more "sets" of conductive electrodes disposed thereon, all of the electrodes residing in the same plane. Each set of electrodes comprises three different plates: an oscillator, a horizontal sensor and a vertical sensor. The plates in the set comprise planar electrodes physically separate from each other by predetermined distances that are determined by the resulting height and widths of the metallic characters on the thread substrate. The oscillator plate is disposed next to the horizontal sensor plate along the same axis as the height of the security thread characters. The spacing between the oscillator plate and the horizontal sensor plate is smaller than the height of the characters. Further, the vertical sensor plate is disposed to the side of both the oscillator plate and the horizontal sensor plate, and along the major axis of the thread. The spacing between the vertical sensor plate and either the oscillator plate or the horizontal sensor plate is greater than the greatest width of any character. Also, the sets of plates are sequentially disposed across the circuit board at similar spacings therebetween.

All of the oscillator plates are electrically connected together and also to an oscillating signal source. Also, all of the horizontal sensor plates are electrically connected together, while all of the vertical sensor plates are electrically connected together. The horizontal and vertical plates are connected to separate channels of signal processing electronics.

In operation, the currency banknote is moved across the circuit board with its "narrow" height dimension as the leading edge. That is, the banknote is moved in a direction parallel to the height of the characters on the security thread. The aforementioned spacing of all of the electrode plates is such that a banknote with a valid currency thread embedded therein will have one or more of its metallized characters form part of a capacitor and "bridge" the gap (i.e., physical spacing) between a corresponding oscillator plate and the horizontal sensor plate, thereby capacitively coupling the oscillator signal into the horizontal sensor plate. The coupled oscillator signal is sensed and processed to indicate the presence of a valid security thread. At the same time, the characters of a genuine security thread are not wide enough to "bridge" the gap between any vertical sensor plate and the corresponding nearby oscillator plate. Thus, the oscillator signal is not capacitively coupled into the vertical sensor plate. On the other hand, if a counterfeit note exists, such as an electrically-conductive, continuous pencil mark across the entire length of the thread on the surface of the banknote, then the pencil mark will bridge the spacing between an oscillator plate and one or more of both the horizontal sensor plates and the vertical sensor plates. The signal processing electronics will sense this condition and process it as a counterfeit note.

DETAIL DESCRIPTION OF THE PREFERRED EMBODIMENTS

Figure 1:
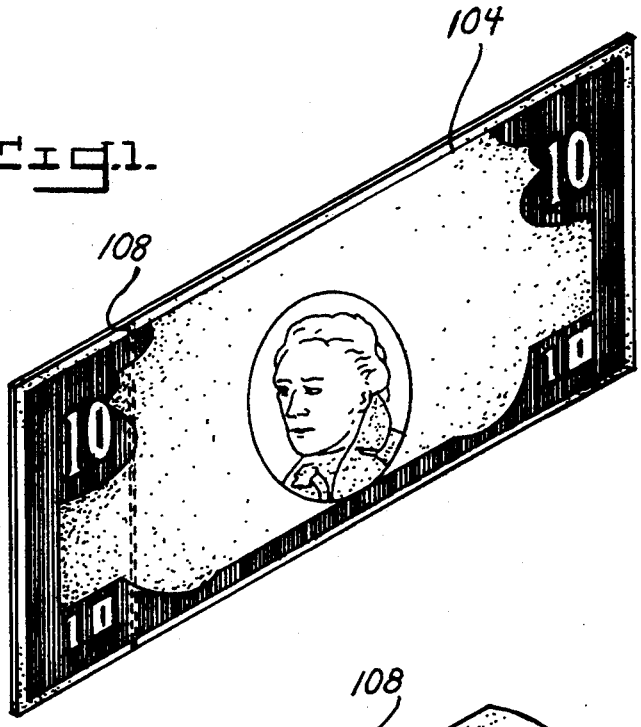
FIG. 1 is a perspective view of U.S. currency paper having a metallized security thread embedded therein.

Referring to the drawings in detail, a preferred embodiment of a currency paper security thread verification device is shown and generally designated by the reference numeral 100. The verification device 100 is for use with currency paper 104 having a security thread 108 embedded therein. The security thread 108 has a plurality of metallized characters 112 disposed on a surface of a plastic substrate 116. The verification device 100 includes a printed circuit board 120 having an arrangement of one or more "sets" 124 of electrodes, each set 124 of electrodes comprising an oscillator 128, a horizontal sensor 132 and a vertical sensor 136. Signal processing electronics 140 provides an oscillator signal 144 to the oscillator electrodes 128, and determines the presence or absence of a valid security thread 108. A valid security thread 108 is indicated when one of the metallized characters 112 of the thread 108 capacitively couples the oscillator signal 144 into a corresponding horizontal electrode 132, while at the same time there is a lack of any capacitive coupling of the oscillator signal 144 into a vertical electrode 136. A counterfeit thread is determined when the oscillator signal 144 is capacitively coupled into both a horizontal electrode 132 and a vertical electrode 136.

Figure 2:
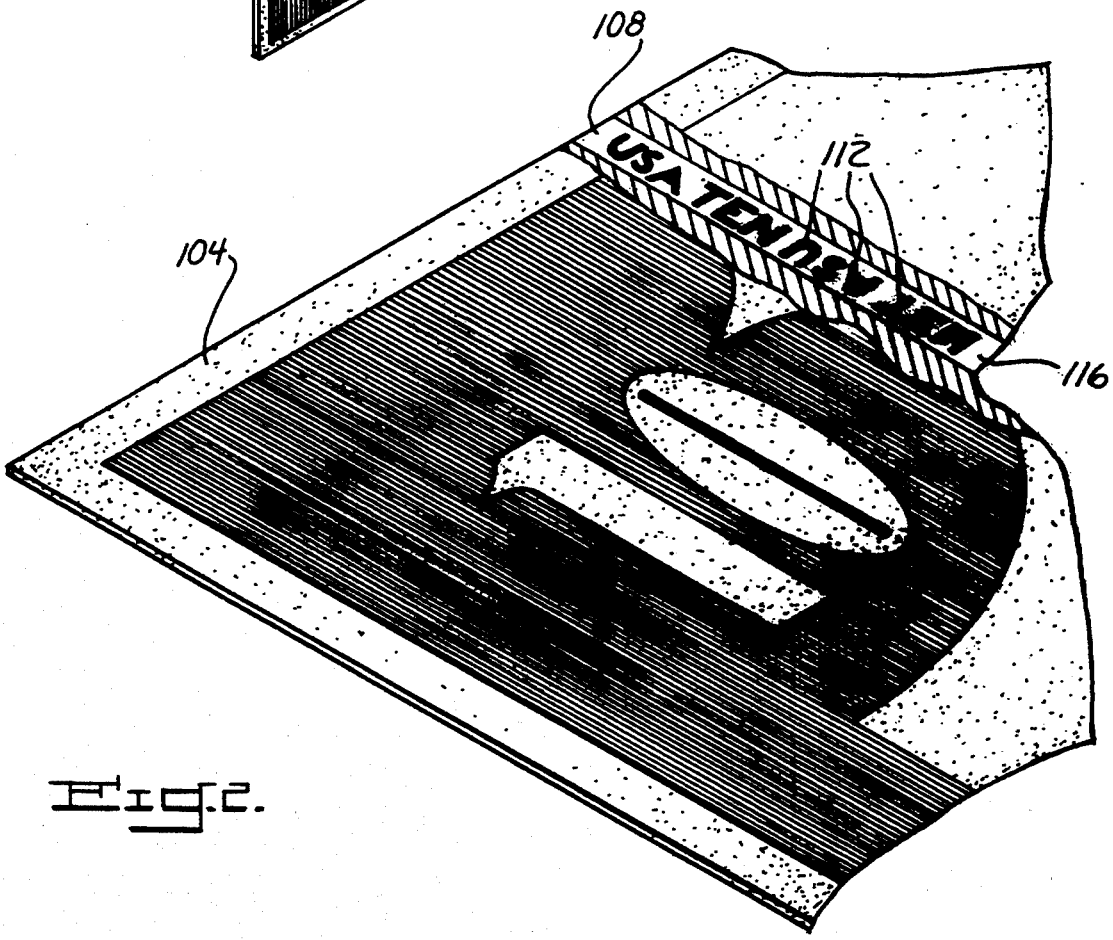
FIG. 2 is a perspective view of a portion of the currency paper of FIG. 1, illustrating in greater detail the embedded security thread in a cut-away view.

FIGS. 1 and 2 illustrate an example of currency paper 104 of the United States. The currency 104 includes the security thread 108 (illustrated in phantom) embedded entirely within the paper 104, and not disposed on any surface of the paper 104. The thread 108 extends from top to bottom and transversely across the linear extent of the currency paper 104. The thread 108 comprises a polyester or plastic substrate 116 having a plurality of metallized, alphanumeric characters 112 vacuum-deposited onto a surface of the substrate 116. The thread 108 may comprise that described in the aforementioned U.S. Pats. Nos. 4,652,015 and 4,761,205 to Crane, which are both hereby incorporated by reference.

As can be seen in greater detail in FIG. 2, the plurality of characters 112 are all separate from each other. Thus, there is a lack of any electrical continuity between any of the characters 112. The characters 112 are all of the same height, while their widths vary depending upon the individual character 112. Typically, the character 112 having the greatest width is that of the letter "W". The characters 112 are arranged heightwise in a direction perpendicular to the major axis or length of the thread 108, and parallel to the "narrow" dimension of the currency paper 104. The thread 108 is completely embedded within the paper 104 and not present on any surface of the paper 104. The thread 108 is visible when exposed to transmitted light, yet invisible in the presence of reflected light.

Figure 3:
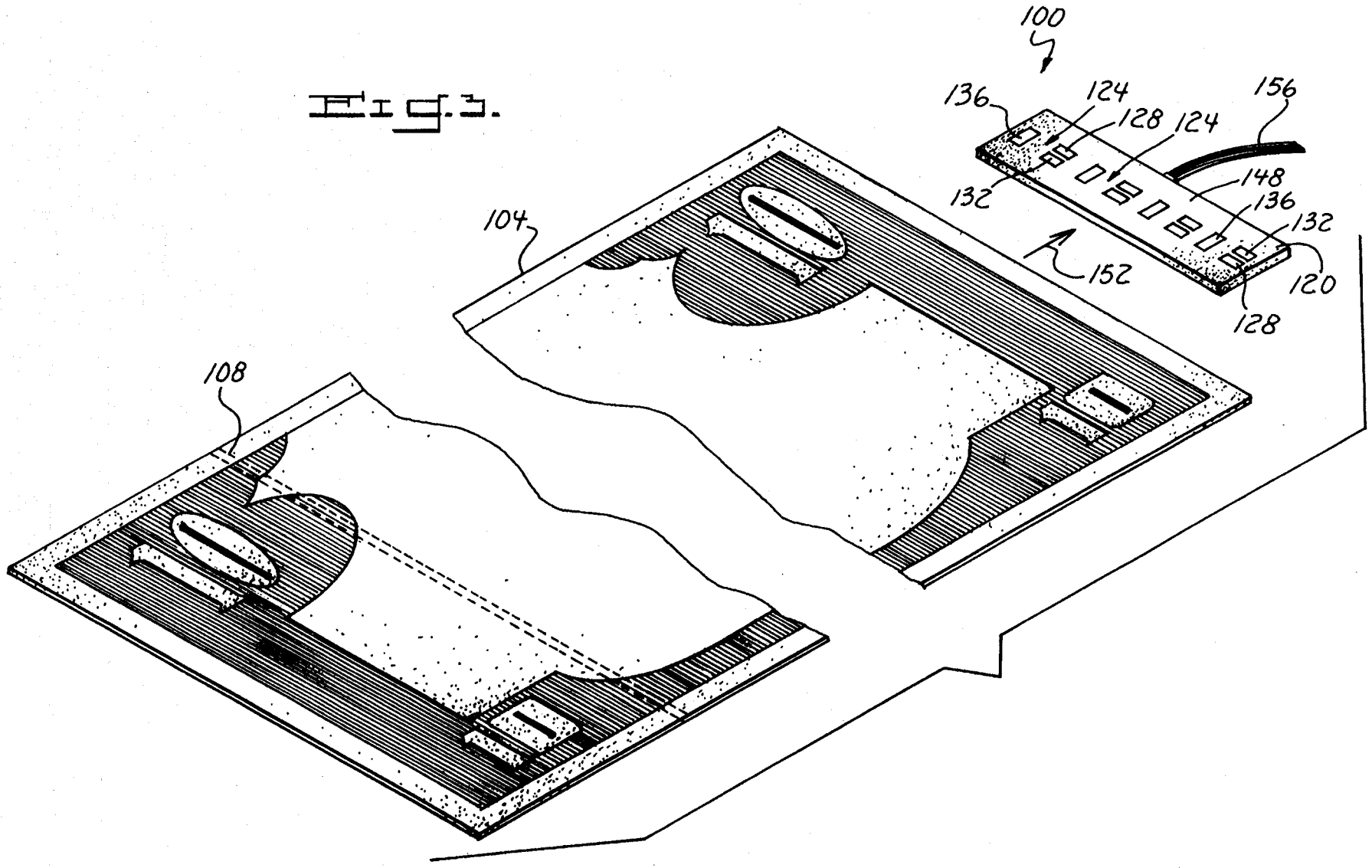
FIG. 3 illustrates the currency paper of FIG. 1 being directed toward a printed circuit board containing the arrangement of electrodes according to the verification device of the present invention.
Figure 4A:
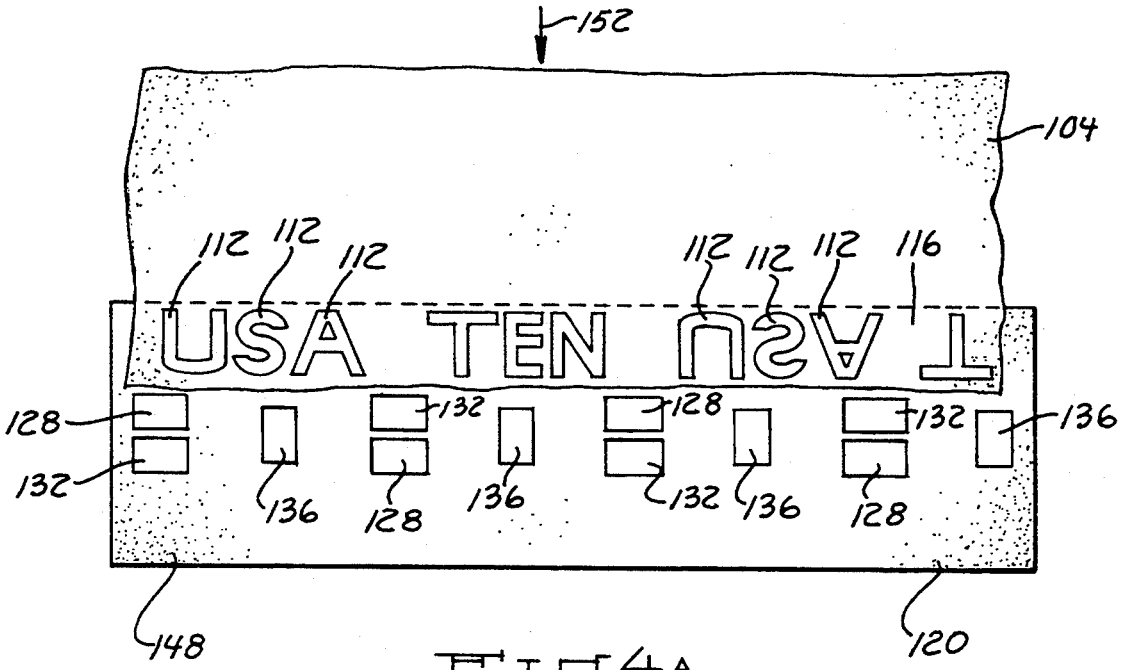
FIGS. 4(*a*) and 4(*b*) illustrate, respectively, first and second positions of the thread with respect to the electrodes.
Figure 4B:
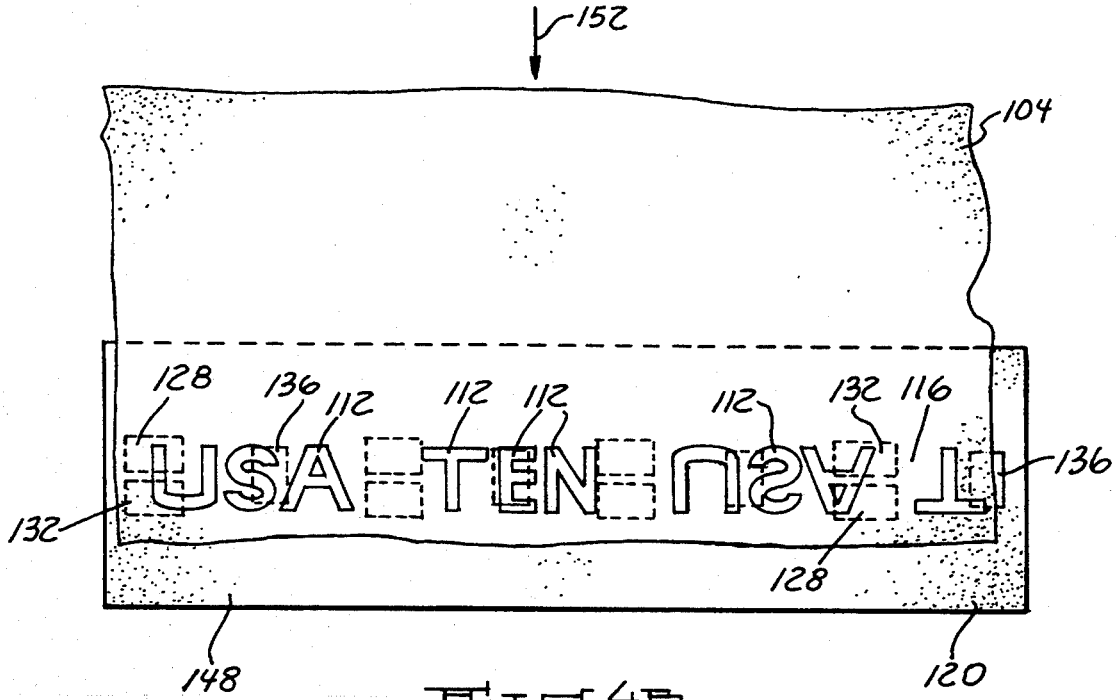
Figure 5:
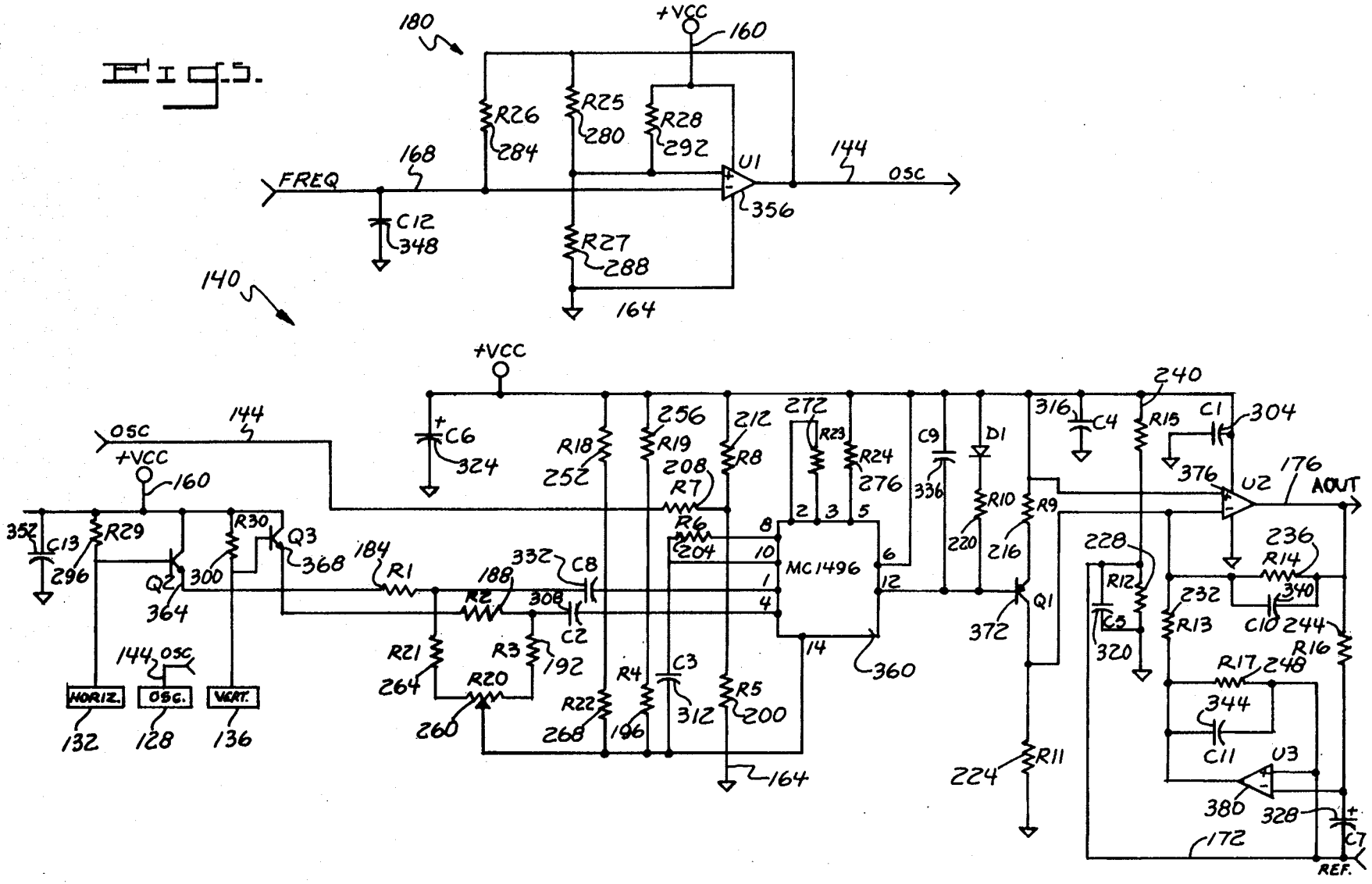
FIG. 5 is a schematic diagram of the electrical connection of the electrodes of FIG. 3, together with associated signal processing electronics.

Referring now to FIGS. 3–5, the verification device 100 of the present invention detects the presence of either valid or counterfeit security threads 108 by detecting changes in capacitance which occur when either a valid or counterfeit thread 108 passes over the electrodes 128–136. FIG. 3 illustrates a printed circuit board 120 having a planar, upper surface 148 on which is disposed, in accordance with the present invention, a plurality of metallic electrodes 128–136 in a predetermined configuration. This configuration can also be seen in greater detail in FIGS. 4(*a*) and 4(*b*). The circuit board 120 is non electrically-conductive, while the electrodes 128–136 are all electrically-conductive. The figures illustrate four "sets" 124 of electrodes 128–136. Each set 124 comprises three separate electrodes: an oscillator electrode 128, a horizontal electrode 132 and a vertical electrode 136. Further, each set 124 of electrodes is disposed in an alternating sequence in a direction parallel to the major axis of the thread 108. FIGS. 3, 4(*a*) and 4(*b*) illustrate the direction of travel of a currency paper 104 with respect to the electrodes 128–136 during verification for the presence or absence of a valid security thread 108.

In accordance with the present invention, each oscillator electrode 128 is disposed adjacent to a corresponding horizontal electrode 132 and parallel to the height of the thread characters 112 when the currency paper 104 is moved in the direction indicated by the arrowhead 152. The spacing between any oscillator electrode 128 and a corresponding horizontal electrode 132 is less than the height of the characters 112. On the other hand, each vertical electrode 136 is spaced apart from both the oscillator electrode 128 and horizontal electrode 132 at a predetermined distance that is greater than the width of any of the characters 112. In the preferred embodiment of the present invention, all of the oscillator electrodes 128 are electrically connected together. In a similar manner, all of the horizontal electrodes 132 are electrically connected together, and all of the vertical electrodes 136 are electrically connected together. This type of connection provides for better signal-to-noise characteristics in the signal processing electronics 140, described in detail with respect to FIG. 5.

In FIG. 5 is illustrated a schematic block diagram of all of the electrodes 128–136, together with signal processing circuitry 140 for ascertaining the presence or absence of valid or counterfeit security threads 108 associated with the currency paper 104. All of this circuitry 140 may be disposed on the printed circuit board 120 in the form of either discrete components or, in a preferred embodiment, the majority of the components illustrated in FIG. 5 may be implemented within an application specific integrated circuit ("ASIC"). The circuitry 140 may be used in conjunction with a bill acceptor or changer that is part of an unattended, self-service vending machine (not shown). The bill acceptor/changer forms the "host" system, comprising its own electronics (not shown) for carrying out the functions associated with that particular vending machine. The circuitry 140 of FIG. 5 interfaces with the host through a number of signals that are connected to the host by a plurality of signal wires 156, illustrated in FIG. 3. The host provides to the circuitry 140 on the circuit board 120 both power ("+VCC") 160 and ground signals 164, along with the signals "FREQ" 68 and "REF" 172. These latter two signals 168, 172 will be described in detail hereinafter. The circuitry 140 provides to the host system a signal, "AOUT" 176, indicative of the presence or absence of either a valid or counterfeit security thread 108.

The circuitry 140 of FIG. 5 includes an oscillator circuit 180 that provides a time-varying, square-wave signal 144 at a frequency of approximately 1–2 MHz. If the capacitor, C12 348, is inserted into the oscillator circuit 180, then the oscillator circuit, comprised of a number of resistors R25–R28 280–292 and an op-amp U1 356, generates the oscillator signal 144. Conversely, if the capacitor C12 348 is deleted from the circuit 180, then the oscillator signal 144 is provided by the host as the signal "FREQ" 168, and the op-amp U1 356 merely acts as a voltage follower. The op-amp U1 356 may comprise the commercially-available Model TL714C, available from Motorola. The values for all of the resistors 184–300 and capacitors 304–352 comprising the circuitry 140 of FIG. 5 are given in Tables I and II, respectively.

TABLE I

| REFERENCE NO. | RESISTOR NO. | RESISTANCE VALUE (OHMS) |
|---|---|---|
| 184 | R1 | 1K |
| 188 | R2 | 1K |
| 192 | R3 | 1K |
| 196 | R4 | 10K |
| 200 | R5 | 6.8K |

TABLE I-continued

| REFERENCE NO. | RESISTOR NO. | RESISTANCE VALUE (OHMS) |
|---|---|---|
| 204 | R6 | 1K |
| 208 | R7 | 33K |
| 212 | R8 | 2.2K |
| 216 | R9 | 750 |
| 220 | R10 | 2K |
| 224 | R11 | 2K |
| 228 | R12 | 20K |
| 232 | R13 | 2K |
| 236 | R14 | 10K |
| 240 | R15 | 20K |
| 244 | R16 | 1M |
| 248 | R17 | 1M |
| 252 | R18 | 33K |
| 256 | R19 | 33K |
| 260 | R20 | 500 |
| 264 | R21 | 1K |
| 268 | R22 | 10K |
| 272 | R23 | 470 |
| 276 | R24 | 10K |
| 280 | R25 | 10K |
| 284 | R26 | 10K |
| 288 | R27 | 10K |
| 292 | R28 | 10K |
| 296 | R29 | 470K |
| 300 | R30 | 470K |

TABLE II

| REFERENCE NO. | CAPACITOR NO. | CAPACITIVE VALUE |
|---|---|---|
| 304 | C1 | 0.1 uf |
| 308 | C2 | 0.1 uf |
| 312 | C3 | 0.01 uf |
| 316 | C4 | 0.1 uf |
| 320 | C5 | 0.1 uf |
| 324 | C6 | 10 uf |
| 328 | C7 | 0.1 uf |
| 332 | C8 | 0.1 uf |
| 336 | C9 | 0.01 uf |
| 340 | C10 | 0.1 uf |
| 344 | C11 | 0.01 uf |
| 348 | C12 | 100 pf |
| 352 | C13 | 0.1 uf |

The oscillator signal 144 is provided to the four oscillator electrodes 128 electrically connected together. The oscillator signal 144 is also provided through resistors R6 204 and R7 208 to a pair of inputs of a Model MC1496 balanced modulator/demodulator integrated circuit 360, provided by Motorola. The function of this demodulator 360 will be described in greater detail hereinafter.

The four horizontal electrodes 132, all electrically connected together, are connected to the positive voltage supply (+VCC 160, which typically equals positive 5 volts) through a resistor, R29 296. The horizontal electrodes 132 are also connected to the base of an NPN transistor, Q2 364, which may comprise the Model 2N2369, commercially available from Motorola. The collector of Q2 364 is connected to the positive voltage supply 160, which provides a charge onto the horizontal electrodes 132 that is sensed by the base of the transistor Q2 364.

In a similar manner, the four vertical electrodes 136, all electrically connected together, are connected to the positive voltage supply 160 through a resistor, R30 300, and also to the base of an NPN transistor, Q3 368. This transistor may also comprise the Model 2N2369. The emitter terminals of these transistors, Q2 364 and Q3 368, represent the outputs indicative of the amount of electrical charge on the corresponding horizontal and vertical electrodes 132, 136. These emitters are connected through resistor and capacitor networks to a pair of signal inputs on the demodulator 360.

In operation of the verification device 100 of the present invention, a currency paper 104 is directed to pass over the surface 148 of the printed circuit board 120 containing the electrodes 128–136, as illustrated in FIGS. 3, 4(*a*) and 4(*b*). FIG. 4(*a*) is representative of the instance where the metallized characters 112 of the security thread 108 are disposed just before the electrodes 128–136. FIG. 4(*b*) is illustrative of the instance where the characters 112 are disposed directly above the electrodes 128–136. As can be seen from these figures, the physical spacing between the oscillator electrodes 128, the horizontal electrodes 132 and the vertical electrodes 136 are such that a metallized character 112 will bridge the "gap" or spacing between a horizontal electrode 132 and an oscillator electrode 128. In this instance, the oscillator electrodes 128 and the horizontal electrodes 132 each comprise one plate of a capacitor. The other plate of the capacitor is formed by the metallized character 112 of the thread 108. The character 112 acts to capacitively couple the electrical charge on the oscillator electrode 128, in the form of the time-varying signal 144, over to the horizontal electrode 132. This results in an increased amount of electrical charge on the horizontal electrode 132, which changes the capacitance seen by the base of the transistor, Q2 364. This has the further result of altering the characteristic of the signal at the emitter terminal of Q2 364, and subsequently at the input to the demodulator 360.

At the same time, it can be seen from FIG. 4(*b*) that none of the metallized characters 112 are wide enough to bridge the spacing between an oscillator electrode 128 and any vertical electrode 136. Thus, the oscillator signal 144 is not capacitively coupled into any vertical electrode 136. This has the further result of keeping the charge and, thus, the capacitance, at the base of transistor Q3 368 constant. Therefore, the resulting signal out of the emitter terminal of transistor Q3 368 and fed to a second input of the demodulator 360 remains constant. The output of the demodulator 360 at pin 12 is a signal that has amplitude variations in only one direction when the two signals at its inputs, pins 1 and 4, differ as a result of the capacitive coupling of the oscillator signal 144 into only the horizontal electrodes 132 and not the vertical electrodes 136. The output signal from the demodulator 360 is fed to a PNP transistor, Q1 372, which may comprise the Model 2N2907, available from Motorola. The transistor, Q1 372, functions as a current amplifier and applies its output at the collector to the negative input of an op-amp U2 376, which may comprise the Model LM358, available from Motorola. Op-amp U2 376 is configured as an inverting amplifier, and its output signal "AOUT" 176 is indicative of the demodulator output.

The circuitry 140 of FIG. 5 further includes another op-amp, U3 380, which may also comprise the Model LM358, available from Motorola, configured as an amplifier. On the negative input of op-amp U3 380 is fed the voltage value on the capacitor, C7 328, which charges as a function of the DC value of the signal AOUT 176. The capacitor voltage is compared to the signal REF 172 from the host system and any difference therebetween is output from the op-amp U3 380 to the negative terminal of the op-amp U2 376. The op-amp U3 380 removes any DC voltage bias from the signal AOUT 176. Normally, AOUT 176 is an AC signal whose average value is equal to approximately one-half of the positive voltage supply 160. The signal REF 172 is merely a DC voltage of a predetermined value. The signal REF 172 is also fed to the positive input of the op-amp U2 376.

The circuitry 140 of FIG. 5 also includes a potentiometer, R20 260, that is adjustable to offset any differences in the gains of the transistors Q2 364 and Q3 368. The remainder of the connections of the components in FIG. 5 should be apparent to one of ordinary skill in the art. As mentioned earlier, the component values for the resistors and capacitors are given in Tables I and II respectively. Diode D1 384 may comprise a Model 1N914, available from Motorola.

The operation of the circuitry 140 of FIG. 5 has been described hereinbefore with respect to a valid security thread 108. However, if currency paper 104 with a counterfeit mark, such as a conductive pencil mark on the surface of the paper 104, is passed over the electrode arrangement of the present invention, the signal processing electronics 140 senses this condition and provides an indication thereof. The counterfeit conductive pencil mark will typically bridge the spacing between an oscillator electrode 128 and an horizontal electrode 132, and will also bridge the spacing between an oscillator electrode 128 and a vertical electrode 136. Such "bridging" does not necessarily have to occur within the same set 124 of electrodes. By providing a plurality of sets 124 of electrodes, the ability to detect counterfeit threads is increased. When the oscillator signal 144 is coupled from an oscillator electrode 128 into both a horizontal electrode 132 and a vertical electrode 136, the resulting signals input to the demodulator 360 are equal. The output of the demodulator 360 comprises a signal that transitions both above and below the midpoint of the signal. This condition is indicated at the output of the inverting amplifier U2 376 by the signal AOUT 176. The host system in response to the signal AOUT 176 being indicative of a counterfeit currency paper 104, may then reject acceptance of such currency paper 104 as payment for the goods.

A counterfeit currency paper 104 may also be indicated by a condition where there is no coupling of the oscillator signal 144 from the oscillator electrodes 128 into any of either of the horizontal or vertical electrodes 132, 136. Also, a counterfeit currency paper 104 may be indicated by a condition where the oscillator signal 144 is coupled into one or more vertical electrodes 136 but none of the horizontal electrodes 132.

The present invention has been described with respect to a preferred embodiment having four "sets" 124 of electrodes. It is to be understood that the broadest scope of the present invention contemplates use of a single "set" 124 of electrodes. The reasoning behind a plurality of electrode sets 124 was given earlier. Further, the preferred embodiment of the present invention has described signal processing circuitry 140 that is exemplary. It suffices for the broadest scope of the present invention that signal processing means 140 be provided that sense signals from both the horizontal and vertical electrodes 132, 136 and interpret the condition where the oscillator signal 144 is coupled into the horizontal electrode 132 and not the vertical electrode 136 as being indicative of a valid security thread 108. Further, the signal processing circuitry 140 interprets the other three possible conditions of coupling of the oscillator signal 144 either into or not into the horizontal and vertical electrodes 132, 136 as indicative of the lack of a valid security thread 108.

The verification device 100 of the present invention has been described for use with a thread 108 that has specific alphanumeric, metallized characters 112 formed on a plastic substrate 112 embedded within the paper 104. However, it is to be understood that the present invention is not limited as such; the present invention may be utilized with other types of security threads 108. These threads 108 may or may not be embedded within the paper 104. Also, the electrically conductive material that is either part of, or disposed on, the thread 108 does not have to take any specific shape. It suffices that an electrically-conductive region 112 be associated with a security thread 108, and such region 112 has a predetermined height and width that can dictate the resulting spacing of the oscillator, horizontal and vertical electrodes 128–136 of the verification device 100 of the present invention. This will enable the signal processing electronics 140 to sense a valid thread 108 when the metallized region 112 bridges the spacing between an oscillator electrode 128 and a horizontal electrode 132, and at the same time, the metallized region 112 does not bridge the spacing between the oscillator electrode 128 and a vertical electrode 136.

Still further, it should be understood that the terms "horizontal" and "vertical" with respect to labeling of the electrodes 132, 136 is purely exemplary. Other means of distinguishing between the two electrodes 132, 136 may be utilized, without limitation.

The present invention has been described for use with currency paper 104 of the United States. However, the device 100 can be used for currency paper 104 of other countries. Also, it can be used for other types of documents that have a need for authentification; for example, documents evidencing debt obligations or equity positions.

Also, the verification device 100 of the present invention has been described as being utilized within a host system, such as a bill acceptor or changer that is part of a vending machine. However, these types of applications are purely exemplary. The present invention can be utilized in conjunction with a host or as a stand alone device. Further, the host may be a system that accepts currency paper 104 in attended or unattended transactions. Further, the location of the host and its function is not limited herein to vending machines. Other types of machines are contemplated.

It should be understood by those skilled in the art that obvious structural modifications can be made without departing from the spirit of the invention. Accordingly, reference should be made primarily to the accompanying claims, rather than the foregoing Specification, to determine the scope of the invention.

Having thus described the invention, what is claimed is:

1. A device for verifying the authenticity of a document having a security thread associated with the document, the security thread having two or more metallized, electrically-conductive regions, each region being physically separated from one another by a non-conductive region, the device comprising:

a. an oscillator electrode being electrically conductive and having a time-varying oscillator signal applied thereto;

b. a horizontal electrode being electrically conductive and disposed adjacent to and physically separate from the oscillator electrode by a predetermined distance;

c. a vertical electrode being electrically conductive and disposed adjacent to and physically separate from the oscillator electrode by a predetermined distance; and d. signal processing means, connected to all of the oscillator, horizontal electrode and vertical electrode, for providing the oscillator signal to the oscillator electrode, for sensing when the oscillator signal is capacitively coupled to the horizontal electrode, for sensing when the oscillator signal is capacitively coupled to the vertical electrode, and for determining the presence of a valid security thread associated with a document from a first condition where there exists capacitive coupling of the oscillator signal into the horizontal electrode due to a presence of an electrically-conductive region of the thread proximate both the oscillator electrode and the horizontal electrode and from a second condition where there exists a lack of capacitive coupling of the oscillator signal into the vertical electrode due to an absence of an electrically-conductive region of thread proximate both the oscillator electrode and the vertical electrode.

2. The device of claim 1, wherein the signal processing means further comprises means for determining a document to be counterfeit from a condition when there is no capacitive coupling of the oscillator signal to both the horizontal and vertical electrodes, from a condition when there is capacitive coupling of the oscillator signal to both the horizontal and vertical electrodes, or from a condition when there is capacitive coupling of the oscillator signal to the vertical electrode and there is no capacitive coupling of the oscillator signal to the horizontal electrode.

3. The device of claim 1, wherein the predetermined distance separating the oscillator electrode from the horizontal electrode is less than a height of any of the two or more metallized regions of the security thread, whereby any one of the metallized, electrically-conductive regions of the thread is able to capacitively couple the oscillator signal into the horizontal electrode when the region is proximate both the oscillator electrode and the horizontal electrode.

4. The device of claim 1, wherein the predetermined distance separating the oscillator electrode from the vertical electrode is greater than a width of any one of the metallized, electrically-conductive regions of the security thread, whereby any one of the metallized, electrically-conductive regions of the thread cannot capacitively couple the oscillator signal in to the vertical electrode due to the lack of the region being proximate both the oscillator electrode and the horizontal electrode.

5. The device of claim 1, wherein the oscillator electrode, the horizontal electrode and the vertical electrode are all disposed in a plane.

6. A device for verifying the authenticity of a document, an authentic document having a security thread embedded within the document and not present on any surface thereof, the security thread including a non electrically-conductive substrate having metallic, electrically-conductive areas formed on at least one surface of the substrate, the areas all being physically separate from each other such that they are not in electrical continuity therebetween, the device comprising:

a. two or more oscillator electrodes, each oscillator electrode being electrically conductive and having a time-varying oscillator signal applied thereto;

b. two or more horizontal electrodes, each horizontal electrode being electrically conductive, each one of the two or more horizontal electrodes being associated with a corresponding one of the two or more oscillator electrodes such that each horizontal electrode is physically separate from the corresponding oscillator electrode by a predetermined distance;

c. two or more vertical electrodes, each vertical electrode being electrically conductive, each one of the two or more vertical electrodes being associated with a corresponding one of the two or more oscillator electrodes such that each vertical electrode is physically separate from the corresponding oscillator electrode by a predetermined distance; and d. signal processing means, connected to the oscillator electrodes, the horizontal electrodes and the vertical electrodes, for providing the oscillator signal to each of the two or more oscillator electrodes, for sensing when the oscillator signal is capacitively coupled to any one of the two or more horizontal electrodes, for sensing when the oscillator signal is capacitively coupled to any one of the two or more vertical electrodes, and for determining the presence of a valid security thread from any capacitive coupling of the oscillator signal into any one of the two or more horizontal electrodes by the presence of a metallic area of the thread proximate to both an oscillator electrode and a horizontal electrode and from a lack of capacitive coupling of the oscillator signal into the vertical electrode by an absence of a metallic area of the thread proximate to both an oscillator electrode and a vertical electrode.

7. The device of claim 6, wherein the signal processing means further comprises means for determining a counterfeit document from a condition where there is capacitive coupling of the oscillator signal to both one of the horizontal electrodes and one of the vertical electrodes.

8. The device of claim 6, wherein the predetermined distance separating any one of the oscillator electrodes from a corresponding one of the horizontal electrodes is less than a height of any of metallic, electrically-conductive areas of the security thread, whereby any one of the metallic areas is able to capacitively couple the oscillator signal from any one of the oscillator electrodes into the associated horizontal electrode when the area is proximate both an oscillator electrode and a corresponding horizontal electrode.

9. The device of claim 6, wherein the predetermined distance separating any one of the oscillator electrodes from a corresponding one of the vertical electrodes is greater than a largest width of any of the metallic electrically-conductive characters, whereby any one of the areas cannot capacitively couple the oscillator signal into any of the vertical electrodes due to the lack of the area being proximate both an oscillator electrode and a vertical electrode.

10. The device of claim 6, wherein all of the oscillator electrodes are electrically connected together.

11. The device of claim 6, wherein all of the horizontal electrodes are electrically connected together.

12. The device of claim 6, wherein all of the vertical electrodes are electrically connected together.

13. The device of claim 6, wherein all of the oscillator electrodes, all of the horizontal electrodes, and all of the vertical electrodes are disposed on a plane.

14. A device for verifying the authenticity of a currency paper having a security thread embedded therein, the security thread having a non electrically-conductive substrate with a plurality of metallic, electrically-conductive areas formed on a surface of the substrate, the areas all being physically separate from each other such that they are not in electrical continuity therebetween, the verification device comprising:

a. at least one oscillator electrode, each oscillator electrode being electrically conductive and having a time-varying oscillator signal applied thereto, all of the oscillator electrodes being electrically connected together;

b. at least one horizontal electrode, each horizontal electrode being electrically conductive and having all of the horizontal electrodes electrically connected together, each horizontal electrode being associated with a corresponding oscillator electrode such that each horizontal electrode is physically separate from the corresponding oscillator electrode by a predetermined distance;

c. at least one vertical electrode, each vertical electrode being electrically conductive and all of vertical electrodes being electrically connected together, each vertical electrode being associated with a corresponding oscillator electrode such that each vertical electrode is physically separate from the corresponding oscillator electrode by a predetermined distance; and d. signal processing means, connected to all of the oscillator, horizontal and vertical electrodes, for providing the oscillator signal to the oscillator electrodes, for sensing when the oscillator signal is capacitively coupled to any of the horizontal electrodes, for sensing when the oscillator signal is capacitively coupled to any of the vertical electrodes, for determining the presence of a valid security thread from a first condition where there exists capacitive coupling of the oscillator signal into any of the horizontal electrodes and from a second condition where there exists a lack of capacitive coupling of the oscillator signal into any of the vertical electrodes, and for determining the presence of a counterfeit security thread from a condition where there exists capacitive coupling of the oscillator signal into both any one of the horizontal electrodes and any one of the vertical electrodes.

* * * * *